US005310128A

United States Patent [19]

Doeberl et al.

[11] Patent Number: 5,310,128

[45] Date of Patent: May 10, 1994

[54] TAPE STORAGE APPARATUS FOR MAILING MACHINE

[75] Inventors: Terrence M. Doeberl, West Redding; Joseph Gelb, Jr., Milford, both of Conn.

[73] Assignee: Pitney Bowes Inc., Stamford, Conn.

[21] Appl. No.: 14,917

[22] Filed: Feb. 8, 1993

[51] Int. Cl.[5] ..... B65H 35/04

[52] U.S. Cl. ..... 242/55; 226/91; 400/613; 400/692; 83/649

[58] Field of Search ..... 242/55, 58.6; 226/91, 226/92; 400/205.1, 692, 613; 83/649

[56] References Cited

U.S. PATENT DOCUMENTS

| | | | |
|---|---|---|---|
| 3,803,959 | 4/1974 | Rung | 83/649 X |
| 3,880,372 | 4/1975 | Witte | 242/55 |
| 4,388,010 | 6/1983 | Mott et al. | 400/692 |
| 4,699,034 | 10/1987 | Sue | 242/55 X |
| 4,854,806 | 8/1989 | Gertsch et al. | 242/58.6 X |
| 4,993,653 | 2/1991 | Frei | 242/55 X |
| 5,002,235 | 3/1991 | Greer et al. | 242/58.6 |

FOREIGN PATENT DOCUMENTS

| | | | |
|---|---|---|---|
| 0142658 | 6/1987 | Japan | 400/692 |

*Primary Examiner*—Daniel P. Stodola
*Assistant Examiner*—Paul T. Bowen
*Attorney, Agent, or Firm*—Charles G. Parks, Jr.; Melvin J. Scolnick

[57] ABSTRACT

A tape storage apparatus is used with a mailing machine having printing postage indicia on a discrete portion of a strip of tape of indefinite length which is fed along a tape path extending through the mailing machine by a tape feeding device mounted within the mailing machine. The tape storage apparatus includes a base having vertical guide rails and a tape holding device mounted on the guide rails for movement therealong. A releasable latch holds the tape holding device in a lowermost position against the force of a plurality of resilient spring device for moving the tape holding device upwardly to a position in which the tape holding device becomes accessible to an operator or service person for reloading rolls of tape or performing service on the apparatus. When the tape holding device is in its lowermost position, it is functionally integrated with the mailing machine, but it is inaccessible for reloading tape or for threading tape into the feeding device in the mailing machine.

12 Claims, 7 Drawing Sheets

TAPE STORAGE APPARATUS FOR MAILING MACHINE

CROSS REFERENCE TO OTHER PATENTS AND APPLICATIONS

The following discloses a mailing machine with which the present invention can be utilized: U.S. Pat. No. 4,876,956 for REMOVABLE POSTAGE METER HAVING AN INDICIA COVER, assigned to the assignee of this application.

The following disclose a tape tensioning apparatus related to the present invention: U.S. Pat. No. 4,922,085 for MAILING MACHINE TAPE MODULE AND TAPE DRIVE THEREOF; No. 5,007,370 for MAILING MACHINE TAPE MODULE AND TAPE TAKE-UP AND MOISTENING SYSTEM THEREOF; and U.S. Pat. No. 5,016,511 for TAPE CUTTER, all assigned to the assignee of this application.

The following disclose a wrap spring clutch assembly related to this application: U.S. patent application Ser. No. 685,783 for MAILING MACHINE ROLL TAPE DISPENSING APPARATUS; and Ser. No. 08/014,727, filed concurrently herewith, for WRAP SPRING CLUTCH ASSEMBLY, both assigned to the assignee of this application.

BACKGROUND OF THE INVENTION

The present invention relates generally to an apparatus for storing tape which is fed to a printing apparatus, and more particularly to a tape storage apparatus for use in a mailing machine in which tape is selectively moved to and from a printing position in which postage indicia is printed on the tape when the mailing machine is not printing the postage indicia on discrete envelopes.

Modern day mailing machines, such as that shown and described in the aforementioned U.S. Pat. Nos. 4,876,956 and 4,922,085 have evolved into highly, multi-functional machines capable of processing a plurality of mail pieces of different types through the steps required to affix proper postage to them for handling by the U.S. Postal Service. For example, the mailing machine just mentioned can store a plurality of mail pieces in a hopper, successively feed them seriatim to a weighing module which electronically determines the amount or postage required for each mail piece, print that amount of postage as an indicia either directly on the mail piece if it is relatively thin, such as a typical letter envelope or on a strip of tape which is applied to the envelope if it is too thick to feed through the printing mechanism, and finally deposit mail pieces in an orderly fashion in any of a variety of stacking devices for retrieval and further handling by Postal Service representatives. It should also be noted that the foregoing process occurs at a high rate of speed, usually in the order of 2 per second if weighing each piece is involved, 4 per second if weighing is not involved. Thus, it will be apparent that to accomplish this process at the indicated speed, the mailing machine requires a great number of mechanical parts which must fit together accurately and operate smoothly, and a highly complex electronic control system including various operator controlled devices and modules for setting up and operating the mailing machine, microprocessors for controlling the synchronous operation of various components and devices, and diagnostic systems for detecting various malfunctions and providing appropriate indication thereof.

One of the requirements of the mailing machine under consideration is that of providing a continuous supply of tape on which the postage indicia is printed when tape printing is the selected mode of operation. Since the mailing machine operates at a high rate of speed in terms of the number of mail pieces processed as mentioned above, it is necessary to have a large supply of tape available in order to minimize the down time of the mailing machine which would otherwise be required if rolls of tape had to be replaced frequently. In addition, in order for the tape feed mechanism of the mailing machine to function smoothly and properly at a high rate of speed, it is necessary to have a tape storage mechanism which incorporates devices, controls and features for physically storing a large quantity of tape, for maintaining proper tension on the tape during intermittent feeding operations, for detecting when the tape becomes exhausted, for providing proper indication when this occurs, and being mounted in such a manner that it is structurally integrated into the mailing machine for maximum functionality and yet is conveniently accessible to machine operators or service personnel for their respective needs.

In the course of the design and development of the mailing machine with which the present invention was intended for use, many different design concepts were considered for an apparatus which would provide all of the functional requirements mentioned above. All of those considered provided some of these requirements with varying degrees of success, but each failed in one or more respects to meet the design criteria specified. For example, one design called for the tape storage apparatus to swing upwardly on an arc about a pivot point, but this resulted in so much slack in the strip of tape between the roll in the storage device and the input point of the mailing machine that it was difficult to thread the lead edge of the tape into the mailing machine. Another solution was to use two rolls of tape mounted side by side in the tape storage apparatus, but this was considered wasteful, inefficient and added unnecessary complexity and cost to the apparatus.

One particular vexing problem was that of structurally integrating the tape storage apparatus into the mailing machine in a manner which achieved maximum functionality while at the same time maintaining the apparatus conveniently accessible to operators and service people. It was found that when the tape storage apparatus was located when it would function best with the mailing machine, it was virtually completely inaccessible for replacement of rolls of tape or other service; and if located to facilitate access, certain functional problems developed in connection with the smooth feeding of tape from the storage apparatus to the printing module of the mailing machine which were unacceptable, such as difficulty in threading tape into the mailing machine and jamming and tearing of the tape during operation. Thus, prior to the present invention, there was no completely satisfactory tape storage apparatus available for use with the subject mailing machine.

BRIEF SUMMARY OF THE INVENTION

The present invention overcomes the foregoing problems and has been found to provide all of the above mentioned functional requirements and to meet all of the design criteria to a large degree of satisfaction, and has proven to provide highly acceptable solutions to numerous and often vexing problems.

The present invention is a tape storage apparatus for use with a mailing machine which prints postage indicia on a discrete portion of a strip of tape of indefinite length which is fed along a tape path extending through the mailing machine by tape feeding means mounted within the mailing machine. In its broader aspects, the tape storage apparatus includes a base which is adapted to be connected to the mailing machine adjacent to an entrance to the tape path extending through the mailing machine, a substantially vertically oriented guide member which extends upwardly from the base, and a tape holding means which holds a large roll of tape and defines a tape path extending from the point of unwinding of the tape from the roll to an exit location. The apparatus further includes means mounting the tape holding means for movement along the guide member between a lowermost operative position in which the tape holding means is inaccessible in the mailing machine for replacement of a roll of tape and for threading the tape along the tape path in the tape holding means and into the entrance to the tape path in the mailing machine, and an uppermost inoperative position in which the tape holding means becomes accessible for replacement of a roll of tape and for threading the tape as aforementioned. There is a releasable latching mechanism for normally holding the tape holding means in the lowermost position, and there is resilient means for urging the tape holding means upwardly when the latching means is released.

In some of its more limited aspects, the guide member includes a pair of spaced apart rails on which the tape holding means rides between the aforementioned positions, and the resilient means for raising the tape holding means comprises a first spring for quickly snapping the tape holding means away from the base for a short distance and a second spring for raising the tape holding means a substantial distance along the rails. This is accomplished by having the second spring, a torsion spring in the preferred embodiment, drive a shaft on which pinions are mounted which engage with racks on the guide member, the spring being wound so as to drive the tape holding means upwardly when the latching means is released.

The tape storage apparatus further includes a tape tensioning device for maintaining proper tension on the portion of tape which extends from the roll along the aforementioned tape path and into the tape feeding device of the mailing machine, the tensioning device including a wrap spring clutch which functions to prevent rotation of a roll of tape carried by the tape holding means from rotating in an unwinding direction when there is sufficient tape in the aforementioned tape path, and which is released by a tension sensing member to permit rotation of the roll of tape when normal slack in the tape in the tape path is taken up and additional tape is required.

The tensioning device is connected to a tape sensing device which both senses when the tape becomes exhausted and provides an appropriate indication of this condition. The tensioning device is also responsive to upward movement of the tape holding means to the aforementioned uppermost position to both release the wrap spring clutch to provide free rotation of the roll of tape and also to activate the out-of-tape sensing device.

Having briefly described the essential nature of the present invention, it is a general object thereof to provide a tape storage apparatus for a mailing machine which meets all of the design criteria established for the apparatus and which solves all of the problems of prior attempts at designing the subject apparatus.

Another object of the present invention is to provide a tape storage apparatus for a mailing machine which is structurally integrated into the mailing machine to provide maximum functionality and yet is conveniently accessible to operators or service personnel for their respective needs when required. A further object of the present invention is to provide a tape storage apparatus for a mailing machine which is capable of holding a large quantity of tape to minimize the down time of the mailing machine otherwise required during replacement of exhausted tape rolls.

A still further object of the present invention is to provide a tape storage apparatus for a mailing machine which includes a device for maintaining proper tension on the portion of the tape between the roll of tape in the tape storage device and the input feed mechanism of the mailing machine. Another object of the present invention is to provide a tape storage apparatus for a mailing machine which includes a device for detecting when the roll of tape is exhausted and for providing an appropriate indication when this occurs.

Still another object of the present invention is to provide a tape storage apparatus for a mailing machine which is rugged in construction, and simple enough to be loaded, operated and serviced by relatively inexperienced personnel. These and other objects and advantages of the present invention will become more apparent from an understanding of the following detailed description of a presently preferred embodiment of the invention when considered in conjunction with the accompanying drawings.

DETAILED DESCRIPTION OF THE PREFERRED EMBODIMENT

Figure 1:
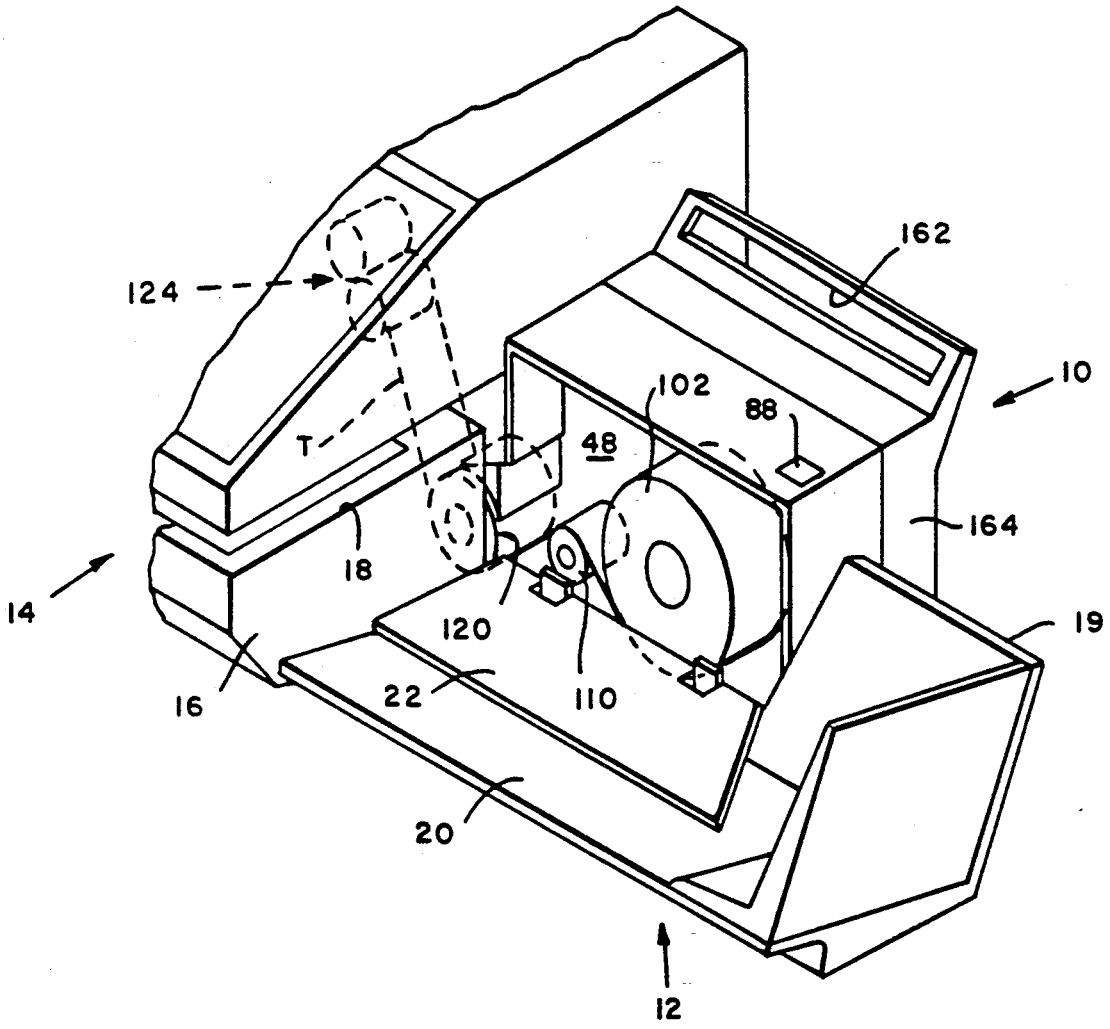
FIG. 1 is a fragmentary perspective view of the tape storage apparatus of the present invention as it appears when installed on the mailing machine for which it was designed and when disposed in the normal operative position.
Figure 2:
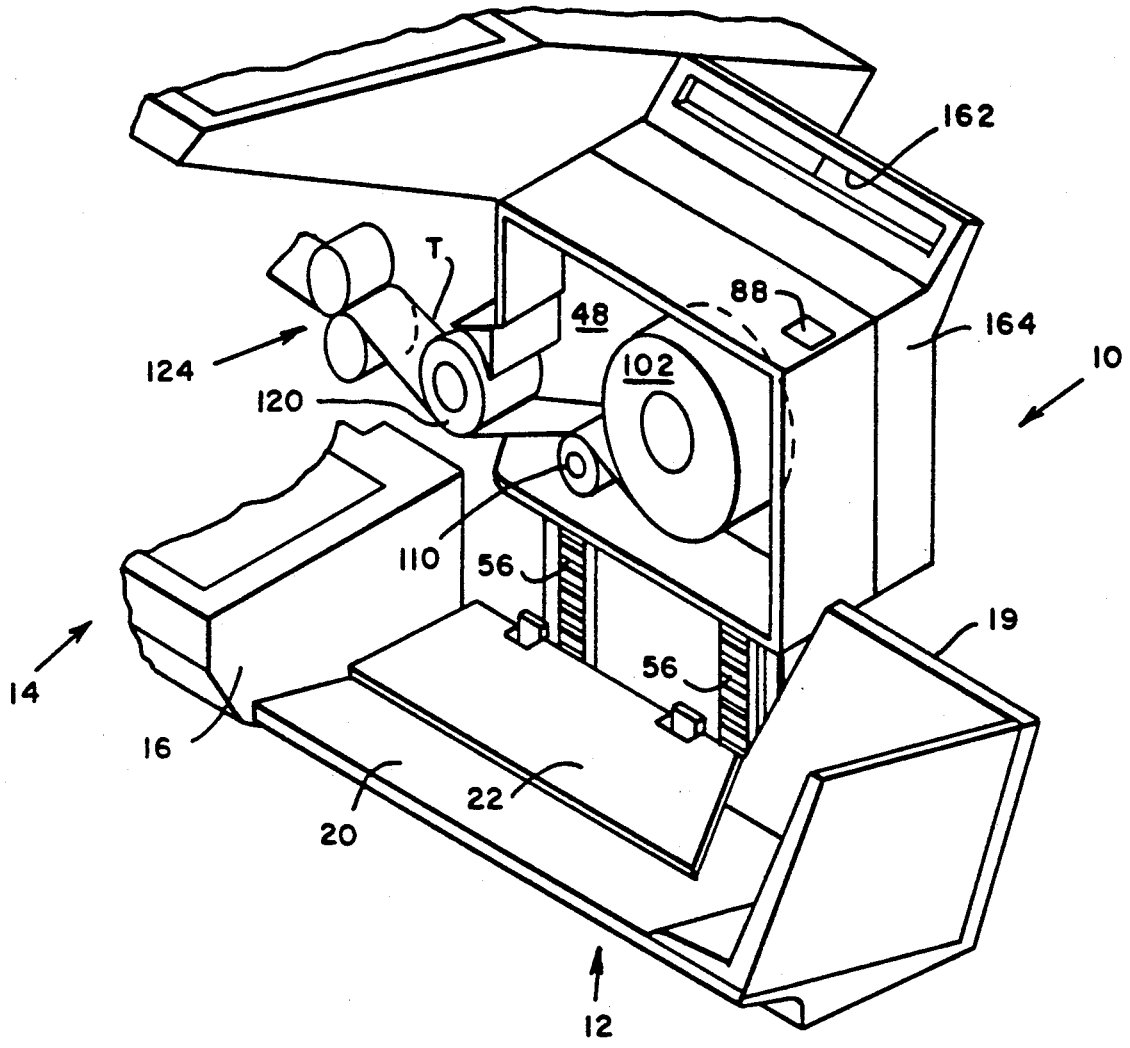
FIG. 2 is a view similar to FIG. 1 but showing the tape storage apparatus disposed in the position it occupies when raised to the inoperative position for tape replacement and threading.

Referring now to the drawings, and particularly to FIGS. 1 and 2 thereof, the tape storage apparatus of the present invention is shown in association with the mailing machine with which it was intended for use. It should be understood that the mailing machine per se forms no part of the present invention and therefore only so much of the mailing machine is shown and described in a fragmentary manner as is necessary to lend clarity to the environment in which the present invention is used.

The tape storage apparatus of the present invention is generally designated by the reference numeral 10. It is connected in a manner to be further described below just behind a suitable mail piece stacker, generally designated by the reference numeral 12, of which several types are available, but all of which serve the purpose of collecting and stacking mail pieces after they have passed through a mailing machine, generally designated by the reference numeral 14. Thus, the stacker 12 is suitably connected to an end wall 16 of the mailing machine 14 where a feed path extending through the mailing machine terminates, as indicated by the slot 18, from which the mail pieces exit after they have been weighed and an appropriate postage indicia printed thereon. The stacker 12, regardless of the type, typically includes an upstanding registration wall 19 connected to the platform 20 of the stacker 12 and which extends from the end wall 16 of the mailing machine 14 over the length of the platform 20. For a purpose described in more detail below, the registration wall 18 includes a flip-down door 22 suitably hinged to the registration wall 20 and which can be manually opened at will by an operator.

Figure 3:
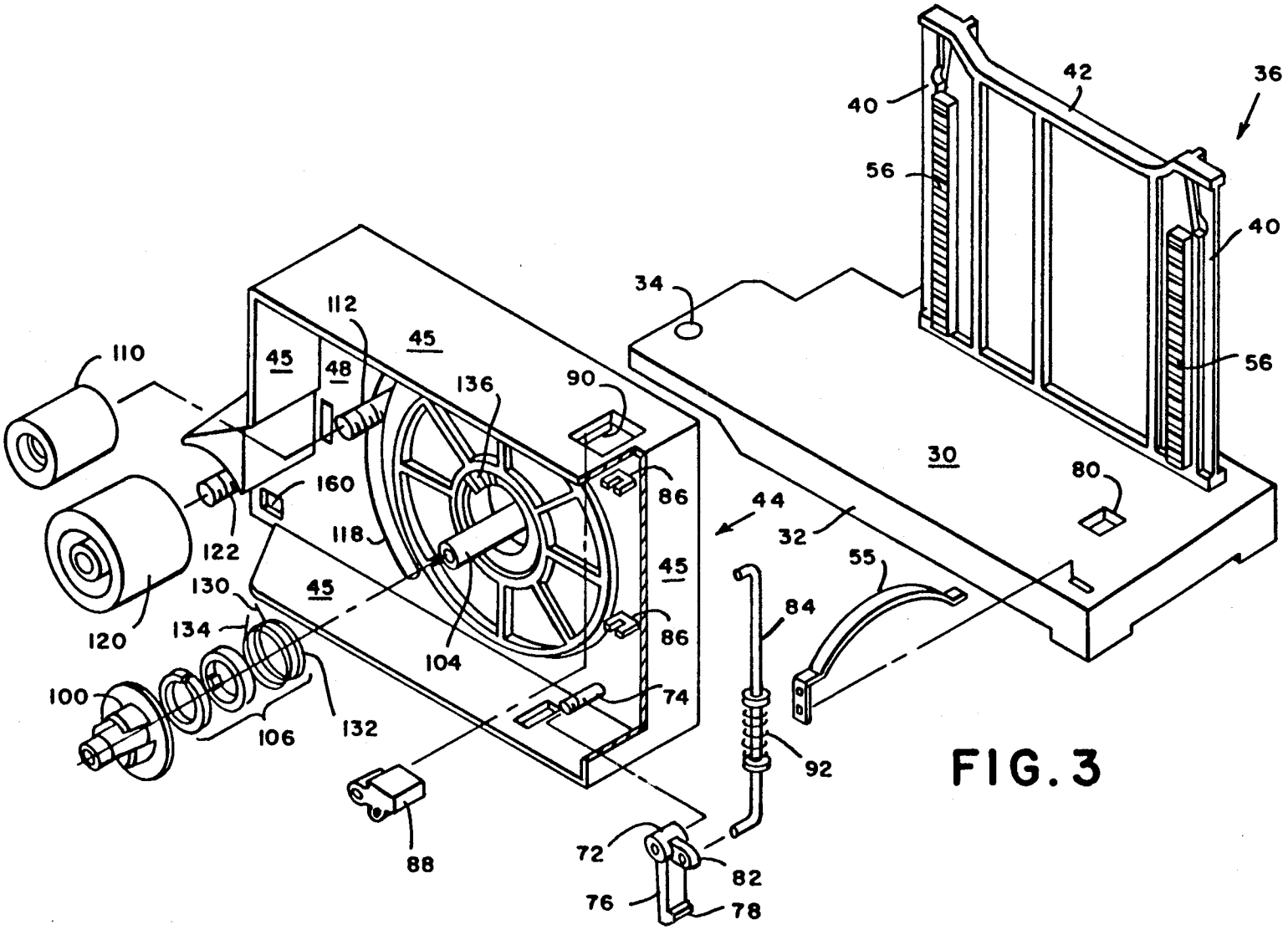
FIG. 3 is an exploded view of the front portion of the tape storage apparatus.
Figure 4:
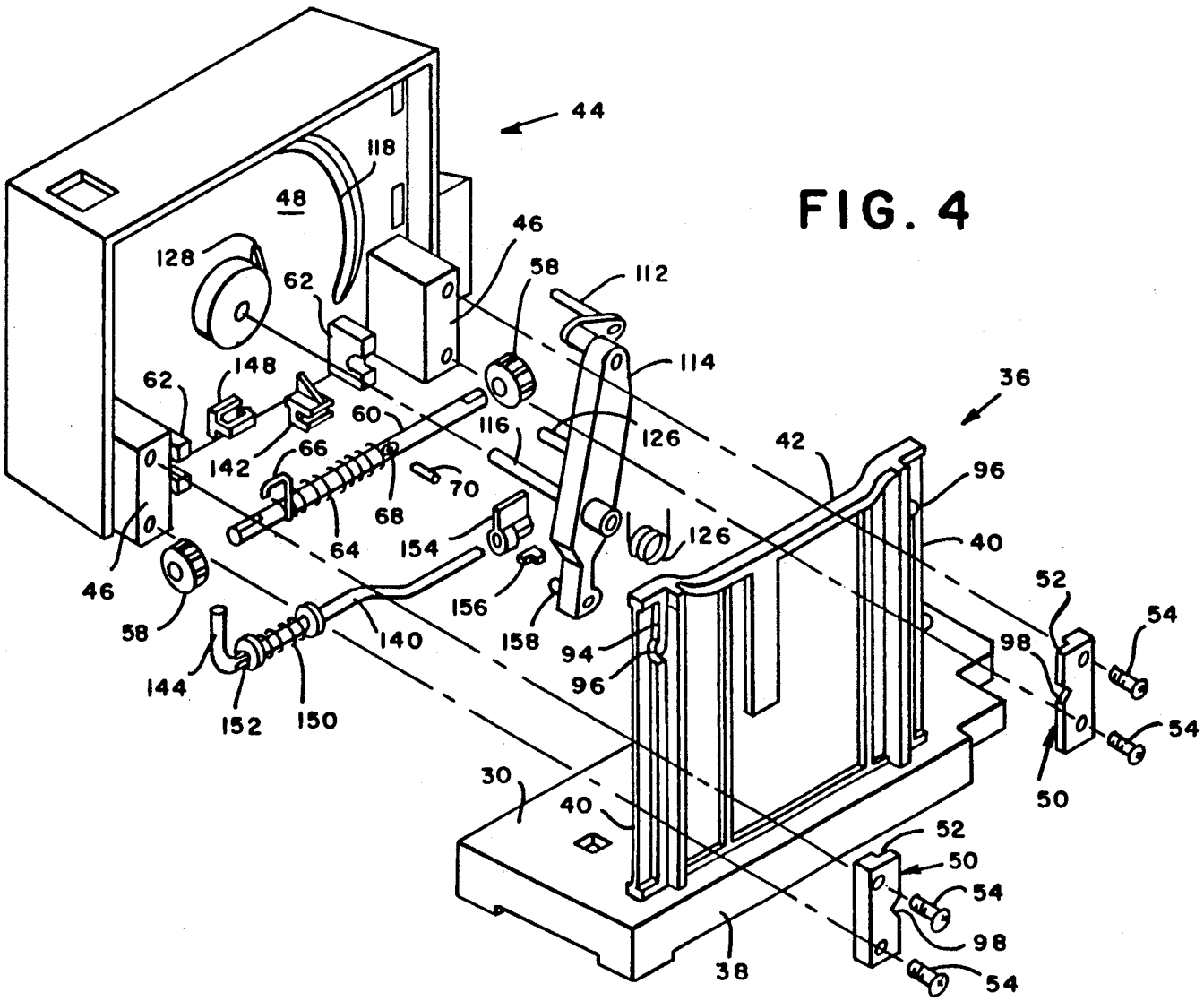
FIG. 4 is an exploded view of the rear portion of the tape storage apparatus.

Referring now to FIGS. 1, 3 and 4, the tape storage apparatus 10 comprises a generally rectangular base 30 having a peripheral skirt 32 and a plurality of holes 34 through which the base 30 is suitably secured to the frame mailing machine 14 as by screws. A guide member, generally designated by the reference numeral 36, is either integrally formed with, or suitably mounted on, the base 30 adjacent a rear wall 38, the guide member 36 being substantially vertically oriented on the base 30. The guide member includes a pair of spaced apart guide rails 40 which extend upwardly from the base 30 substantially to the top 42 of the guide member.

As best seen in FIGS. 3 and 4, the tape storage apparatus includes a generally rectangular box-like housing, generally designated by the reference numeral 44, which includes top, bottom and side walls 45, and a pair of mounting blocks 46 suitably secured to the rear surface of a wall 48 which connects the side walls 45 together. A pair of suitably shaped securing bars 50, each having an undercut 52 formed in one surface thereof, are secured to the mounting blocks 46 by the screws 54 so that the outer faces of the mounting blocks 46 and the inner surface of the undercuts 52 of the securing bars cooperate with opposite surfaces respectively of the rails 40 (see FIG. 5) to permit the mounting blocks 46 and the housing 44 attached thereto to ride up and down on the rails 40 in the manner more fully described below.

The housing 44 is caused to move upwardly along the rails 40 by a pair of resilient spring drives, the first of which is merely an upwardly curved leaf spring 55 which is suitably secured to the base 30, and which is compressed between the upper surface of the base 30 and the lower surface of the bottom wall 45 of the housing 44 when the housing 44 is disposed in its lowermost position along the rails 40. When the housing 44 is released for movement by the releasable latching mechanism described below, the housing will move upwardly a short distance under the influence of the leaf spring 55.

Figure 7:
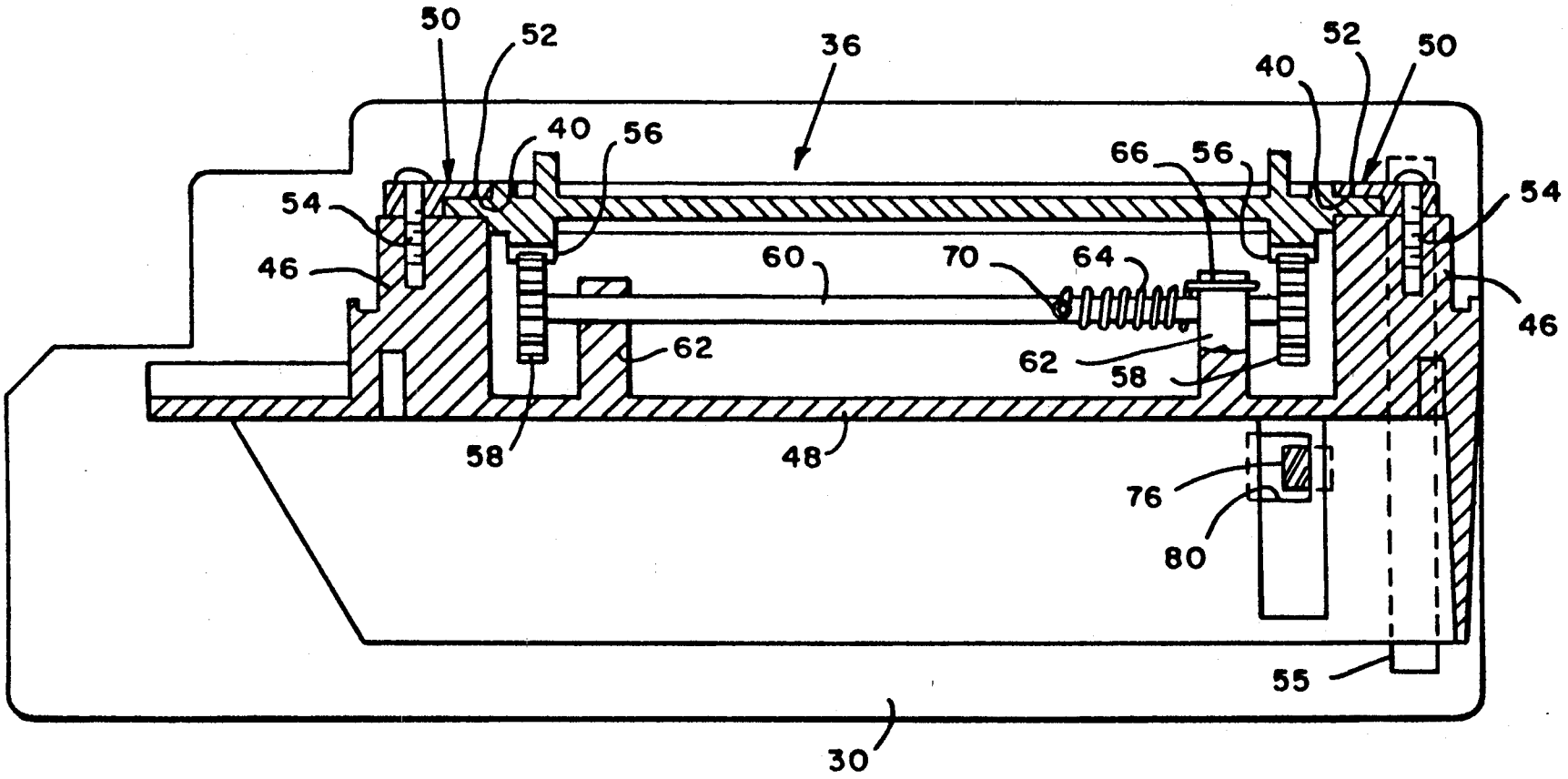
FIG. 7 is a partial sectional plan view taken along the line 7—7 of FIG. 5.

The guide member 36 is provided with a pair of racks 56 which are located adjacent and parallel to the rails 40 and which extend from the base 30 almost to the top of the guide member. A pair of pinions 58 are fixedly mounted on a shaft 60 which is rotatably mounted on the housing 44 as by the bearing blocks 62. A torsion spring 64, which constitutes a second spring drive, is wrapped around the shaft 62, and one end tang 66 of the spring is connected to the bearing block 62 and the other end 68 is connected to the shaft 60 as by the pin 70. As best seen in FIG. 7, when the housing 44 is connected to the guide member 26 in the manner described above, the pinions 58 mesh with the racks 56 in driving relationship and the shaft 60 is captured in the bearing blocks 62. The torsion spring 64 is tightly wound on the shaft 60 prior to assembly of the parts in such a manner that when the housing 44 is in its lowermost position, the torsion spring 64 is exerting a torque on the shaft 60 in a direction that will cause the pinions 58 to rotate in the same direction to cause them to move up the racks 56, thereby moving the entire housing upwardly along the racks 56.

Figure 5:
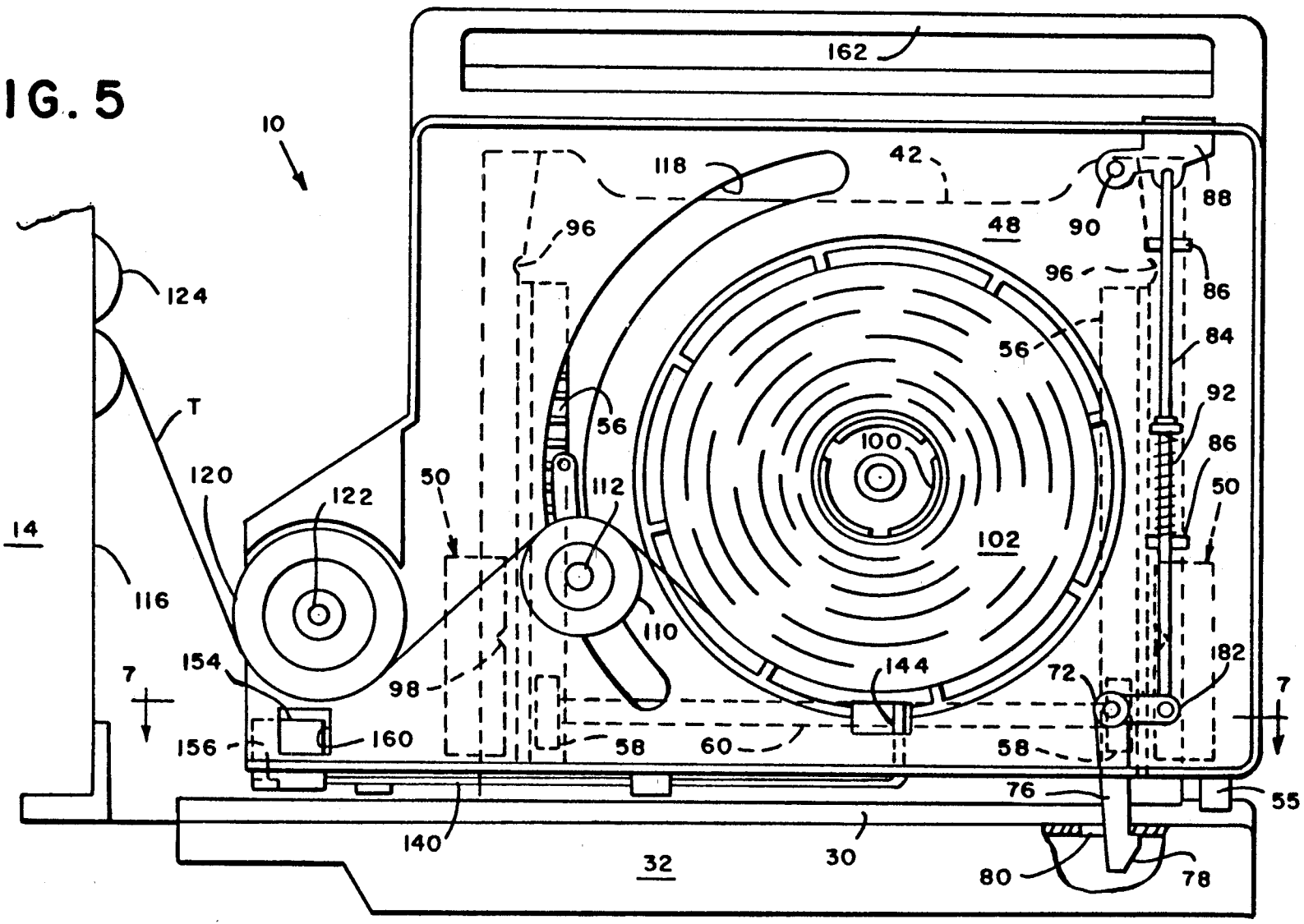
FIG. 5 is a detailed front elevation of the tape storage apparatus when disposed in the normal operative position.

As best seen in FIGS. 3 and 5, the housing 44 is normally maintained a lowermost position by a releasable latching mechanism which comprises a bell crank 72 pivotally mounted on a stub shaft 74 suitably secured to the front face of the wall 48. The bell crank 72 has a generally vertically extending arm 76 which terminates in a latch finger 78, which is adapted to pass through an aperture 80 formed in the base 30 when the housing 44 is in the lowermost position. As best seen in FIG. 5, the latch finger 78 catches on the underside of the base 30 and holds the housing 44 in the lowermost position. The bell crank 72 also has a generally horizontally extending arm 82 which is connected to the lower end of a rod 84 which extends upwardly through suitable guides 86 mounted on the front face of the wall 48 and is connected at its upper end to a push button 88 which is pivotally mounted on another stub shaft 90 suitably secured to the front face of the wall 48. A spring 92 is mounted on the rod 90 and is captured between the upper surface of the lower guide 86 and an abutment formed on the rod 84 so as to urge the rod 84 upwardly. This in turn maintains the latch finger 78 in engagement with the lower surface of the base 30 when the latching mechanism is engaged.

Figure 6:
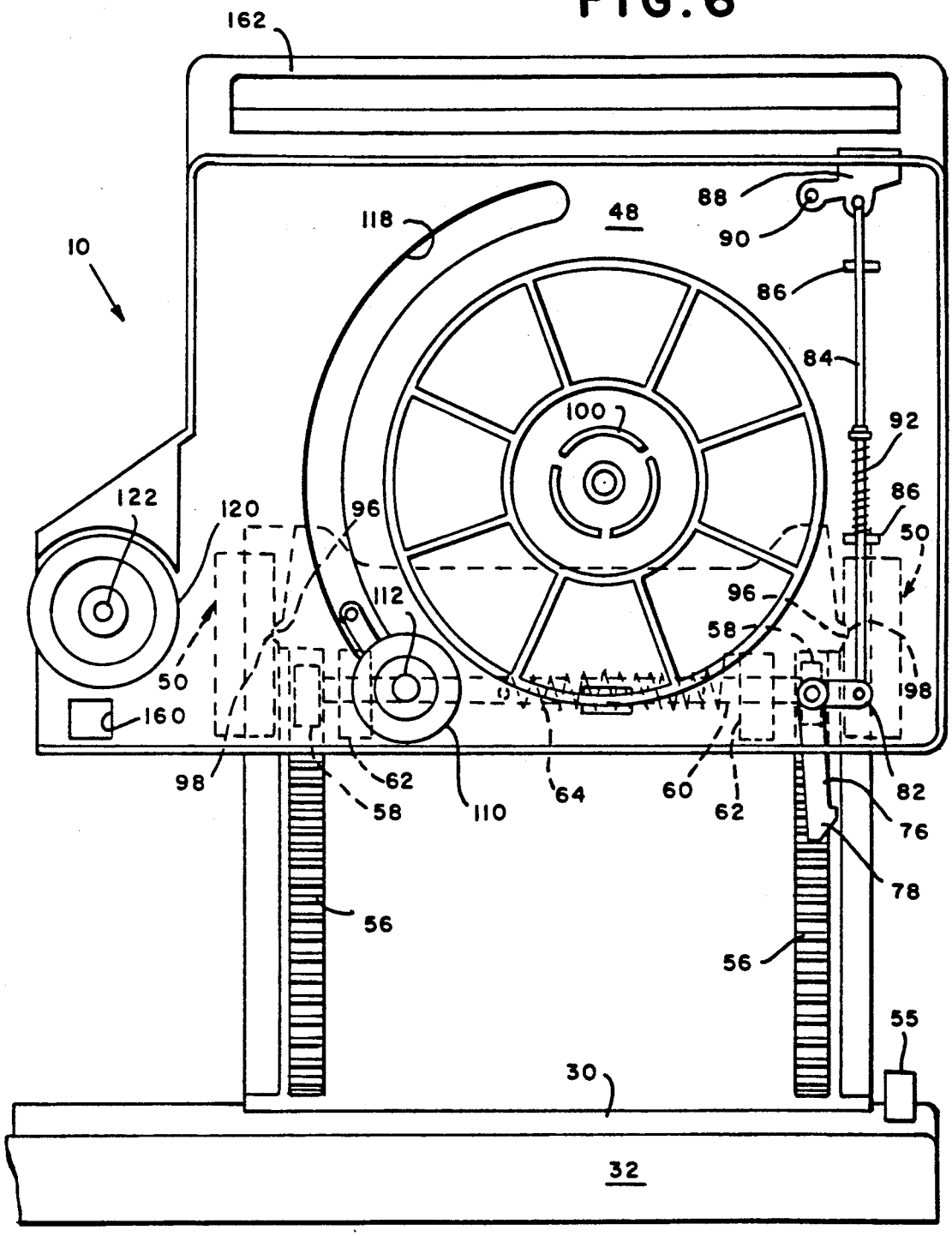
FIG. 6 is a view similar to FIG. 5 but showing the tape storage apparatus in the raised or inoperative position.

As best seen in FIGS. 4 and 6, there is another releasable latching mechanism for maintaining the housing 44 in its uppermost position on the guide member 36. Thus, the guide member 36 is provided with a pair of resilient fingers 94 which project downwardly from the top 42 of the guide member and which terminate in a protrusion 96. Each of the securing bars 50 has a detent 98 for engagement with the protrusion 96 so maintain the housing in its uppermost position. To release this latching mechanism, it is only necessary to push downwardly on the upper wall 45 of the housing with sufficient force to disengage the protrusions 96 from the detents 98.

The housing 44 is part of a tape holding means which is adapted to hold a roll of tape for feeding into the mailing machine in a manner more fully described below. Still referring to FIGS. 3 and 5, the tape holding means comprises a spool assembly 100 on which the roll of tape 102 is mounted, the spool assembly 100 being mounted on the shaft 104 projecting outwardly from the front surface of the wall 48. A wrap spring clutch 106 is interposed between the spool assembly 100 and the wall 48 of the housing 44 for preventing rotation of the spool assembly 100 when the housing 44 is in its uppermost position and also when a tape tensioning means more fully described below senses an excess of slack in the tape leading from the tape holding means into the mailing machine. The wrap spring clutch 106 is fully described and claimed in the aforementioned U.S. patent application Ser. No. 685,783, and is further described herein only to the extent necessary for a full understanding of the present invention.

The tape holding means also includes a tape tensioning mechanism, which is also fully described and claimed in the aforementioned copending U.S. patent application Ser. No. 685,783, and therefore is further described herein only to the extent necessary for a full understanding of the present invention. The tape tensioning mechanism comprises a tensioning roller 110 (FIG. 3) which is rotatably mounted on a shaft 112 suitably connected to one end of a tensioning arm 114 which is pivotally mounted on a shaft 116 projecting outwardly from the rear face of the wall 48. By this arrangement, the tensioning roller 110 can move up and down in the arcuate slot 118 formed in the wall 48. As best seen in FIG. 5, the tape T is threaded over the tensioning roller 110 and then under a guide roller 120 rotatably mounted on a shaft 122 projecting outwardly from the front face of the wall 48, and from there the tape passes into a feed roller assembly 124 mounted in the mailing machine 14 adjacent the end wall 16. The tensioning arm 114 is normally biased upwardly by a tensioning spring 126 so as to maintain tension on the tape T between the roll 102 and the feed roller assembly 124 of the mailing machine. The tensioning arm 114 has a stub shaft 126 mounted above the shaft 116 which projects forwardly through a slot 128 formed in the wall 48 so as to engage a free tang 130 of the spring 132 of the wrap spring clutch 106. The other tang 134 is captured in one of a plurality of slots 136 formed in the front face of the wall 48. The arrangement is such that when the tension in the tape T pulls the tensioning roller 110 down against the bias of the tensioning spring 126, the stub shaft abuts the free tang 130 and moves it in an unwinding direction with respect to the spool assembly 100 so as to permit the spool assembly 100 to rotate and unwind additional tape T from the tape roll 102.

The tape holding apparatus also includes a device for detecting when the roll of tape 102 is exhausted and requires replacement, and also for providing an appropriate visual indication of this condition. The end of roll detecting device operates in conjunction with the tape tensioning mechanism since there is a sudden loss of all tape tension on the tensioning roller 110 when there is no tape T to pull the tensioning roller 110 down against the bias of the tensioning spring 126. Thus, as best seen in FIG. 4, a horizontally oriented rod 140 is slidably mounted in suitable bearing 142 formed on the rear surface of the wall 48, the rod having a vertically extending end portion 144 which moves laterally in guide slot 148 also formed in the rear surface of the wall 48. A compression spring 150 is captured between one side of the bearing 142 and an abutment 152 formed on the rod 140 so as to normally urge the rod toward the left as viewed in FIG. 4. The other end of the rod 140 carries a flag 154 and a magnet 156 to move therewith. A stub shaft 158 is mounted on the tensioning arm 114 adjacent the lower end thereof in a position to contact the vertically extending end portion 144 of the rod 140 when the tensioning arm 114 is in the vertical position shown in FIG. 4, which is the position it assumes in response to the force of the tensioning spring 126 when there is no tape T present to oppose the spring force. When the stub shaft contacts the end portion 144 of the rod 140, it moves the rod 140 toward the right so that the flag 154 is no longer visible through an opening 160 (FIG. 3) in the wall 48, and it also moves the magnet 156 to a position where it activates a suitable switch which energizes a control panel indicator on the mailing machine to advise the operator that the roll of tape 102 is exhausted. If desired, the magnet 156 could also operate a switch that would prevent further operation of the mailing machine until a fresh roll of tape is inserted into the tape storage apparatus.

A description of the operation of the tape storage apparatus as described above will now be given. FIGS. 1 and 5 show the tape storage apparatus 10 in the position is occupies in relation to the mailing machine 14 and the stacker 12. In this position, it is apparent that the tape storage apparatus 10 is functionally integrated with the mailing machine to feed tape directly from the apparatus 10 to the feed roller assembly 124 of the mailing machine 14 along the path represented by the tape T. It should be apparent from FIG. 1 that when the apparatus 10 is in this position, it is inaccessible to an operator either for installation of a roll of tape to replace an exhausted roll or for general service which can be performed without complete disassembly of the tape storage apparatus. Also, it should be apparent that it is impossible to thread the lead edge of a new roll of tape around the tensioning roller 110, the idler roller 120, and into the feed roller assembly 124 of the mailing machine when the tape storage apparatus 10 is in the FIG. 1 position.

During normal operation of the tape storage apparatus 10 in the lowermost or operative position shown in FIGS. 1 and 5, the tape is threaded along the path T, the latch finger 78 is extended through the opening 80 in the base 30 and is engaged with the underside of the base 30 to maintain the housing 44 in the operative position against the force of the springs 55 and 64 tending to raise it. In the static condition of the apparatus 10, the wrap spring clutch 106 is engaged to prevent rotation of the roll of tape 102, but when the feed roller assembly 124 of the mailing machine 14 is activated to draw tape T from the tape storage apparatus 10, the tensioning roller 110 is pulled downwardly to the point where the stub shaft 126 on the tensioning arm 114 abuts the free tang 130 of the clutch spring 132, causing the spring 132 to disengage the clutch and permit the roll of tape 102 to rotate in an unwinding direction until there is sufficient slack in the path of the tape T to permit the tensioning roller 110 to return to its original position under the force of the tensioning spring 126, allowing the wrap spring clutch 106 to reengage and prevent further rotation of the roll of tape 102.

When the roll of tape is exhausted, the end of the strip of tape passes beyond the tensioning roller 110 which is then free to permit the tensioning arm to move to a vertical position as seen in FIG. 4, at which time the stub shaft 158 on the bottom of the tensioning arm 114 abuts the end portion 144 of the rod 140 to move the rod 140 toward the right as viewed in FIG. 4 against the force of the spring 150. This in turn moves the flag 154 out of view through the opening 160 in the wall 48 and also moves the magnet 156 to engage the aforementioned switch or switches to energize a visual out of tape indicator on the mailing machine and, if desired, to deactivate the mailing machine until a new roll of tape is inserted into the tape storage apparatus 10.

In order to replace the exhausted roll of tape and thread the lead end through the tape path indicated by the tape T in FIG. 5, as well as to render the apparatus accessible for any other form of service, it is necessary to open the door 22 and raise the apparatus 10 to the uppermost position shown in FIGS. 2 and 6. This is accomplished by first pressing on the push button 88 to depress the rod 84 against the bias of the spring 92, which in turn rotates the bell crank 72 in a clockwise direction to move the latch finger 78 toward the aperture 80. This allows the housing 44 to move upwardly under the force of the leaf spring 55, which produces a rather sharp and sudden upward movement, but only for a short distance. The essential function of the spring 55 is to abruptly accelerate the housing upwardly so that there is virtually instantaneous acceleration of the housing 44 which induces substantial kinetic energy in the housing 44. Immediately after the housing moves out of contact with the leaf spring 55, the torsion spring 64 starts driving the shaft 60 and the pinions 58 attached thereto in a direction to cause the pinions 58 to move up the racks 56, thereby carrying the entire housing 44 upwardly toward the top 42 of the guide member 36. The torsion spring 64 purposely does not have sufficient torque to drive the housing 44 all the way to the top so that it does not slam into the top of the guide member 36 and cause damage, but rather drives the housing 44 to within a short distance of the top. When it stops, the operator grasps a handle 162 (FIGS. 1 and 2) formed on the upper end of a rectangular enclosure 164 which is suitably attached to the rear portion of the housing 44 merely to enclose it. When the housing reaches its uppermost position on the guide member 36, the projections 96 snap into the detents 98 and retain the housing 44 in this position.

As best seen in FIG. 6, when the housing 44 is in the uppermost or inoperative position, the tensioning roller 110 is disposed at the bottom of the arcuate slot 118 and the tape path indicated by the tape T is very nearly straight leading from the bottom of the tape roll 102 to the feed roller assembly 124 of the mailing machine 14, thereby greatly facilitating threading the tape T into the feed roller assembly. Also, when the tensioning roller 110 is in this position, the stub shaft 126 on the tensioning arm 114 has moved the free tang 130 of the spring 132 of the clutch assembly 106 in an unwinding direction to permit the roll of tape 102 to rotate freely during the threading operation. After the new tape T has been threaded into the feed roller assembly 124 of the mailing machine, the operator pushes the housing 44 downwardly, thereby releasing the protrusions 96 from the detents 98, until the latch finger 78 passes through the aperture 80 and again latches against the underside of the base 30, thereby returning the housing 44 to the position shown in FIGS. 1 and 5 and closes the door 22. It will be apparent to skilled in the art that various modifications and additions may be made to the present invention without departing from the spirit and scope thereof, and it should be understood that the scope of the invention shall be limited only to the extent required as defined in the appended claims.

What is claimed is:

1. A tape storage apparatus for use with a mailing machine having means for printing postage indicia on a discrete portion of a strip of tape of indefinite length which is fed along a tape path extending through the mailing machine by tape feeding means mounted within the mailing machine, said tape storage apparatus comprising:

A) a base adapted to be connected to the mailing machine adjacent to an entrance to the tape path extending through the mailing machine, B) a substantially vertically oriented guide means extending upwardly from said base, C) tape holding means for holding a roll of tape and having means defining a tape path extending from the roll of tape to a tape exit location from said tape holding means, D) means mounting said tape holding means for movement along said guide means between a lowermost position in which said tape holding means is inaccessible in the mailing machine, and an uppermost position in which said tape holding means becomes accessible for replacement of a roll of tape and for threading the tape along said tape path and into the entrance to the tape path in the mailing machine, E) releasable latching means for normally latching said tape holding means in said lowermost position, and F) means for moving said tape holding means upwardly toward said uppermost position when said latching means is released, whereby said tape holding means is normally maintained in a position in which the tape roll is situated for feeding of tape along said tape path in said tape holding means and into the tape path extending through the mailing machine and can be moved to a position in which the tape roll becomes accessible for replacement of the tape roll and for threading of tape along said tape path in said tape holding means into the tape path extending through the mailing machine.

2. A tape storage apparatus as set forth in claim 1 wherein,

A) said guide means comprises means defining a pair of spaced apart guide rails extending upwardly from said base a predetermined distance, and B) said means mounting said tape holding means for movement along said guide means comprises means connected to said tape holding means for sliding along each of said rails over said predetermined distance.

3. A tape storage apparatus as set forth in claim 2 further comprising resilient means for biasing said tape holding means in an upward direction when said latching means is released.

4. A tape storage apparatus as set forth in claim 3 wherein said resilient means comprises:

A) a first resilient means interposed between said base and a lower portion of said tape holding means and adapted to exert an upward force on said tape holding means for a limited distance of movement to move said tape holding means out of contact with said base, and B) a second resilient means operatively interconnected between said guide means and said tape holding means and adapted to exert an upward force on said tape holding means sufficient to raise said tape holding means at least a substantial distance along said guide means beyond limited distance of movement caused by said first resilient means.

5. A tape storage apparatus as set forth in claim 4 wherein said second resilient means comprises:

A) a vertically oriented rack mounted on said guide means,

B) a pinion rotatably mounted on said tape holding means, and

C) spring means interconnected between said pinion and said tape holding means for normally driving said pinion in a direction to cause said pinion to rise along said rack, to drive said tape holding means upwardly said substantial distance along said guide means.

6. A tape storage apparatus as set forth in claim 5 wherein said spring means comprises:

A) a horizontally oriented shaft rotatably mounted on said tape holding means, said pinion being fixedly mounted on said shaft, and B) a torsion spring mounted on said shaft, one end of said torsion spring being connected to said shaft, the other end of said torsion spring being connected to said tape holding means, said spring being prewound on said shaft in a manner to cause said pinion to rise along said rack to drive said tape holding means upwardly said substantial distance along said guide means.

7. A tape storage apparatus as set forth in claim 1 wherein said releasable latching means comprises:

A) a latch member movably mounted on a lower portion of said tape holding means, B) means on said base beneath said latch member for normally engaging with said latch member when said tape holding means is in said lowermost position, and C) manually operable means mounted on said tape holding means for releasing said latch member from said engaging means to permit said tape holding means to move upwardly along said rails in response to said moving means.

8. A tape storage apparatus as set forth in claim 1 wherein said tape holding means further includes tape tensioning means for maintaining the tape between said roll of tape and the tape feeding means of the mailing machine taught while tape is being withdrawn from said tape holding means by the tape feeding means of the mailing machine.

9. A tape storage apparatus as set forth in claim 8 wherein said tape tensioning means comprises:

A) a wrap spring clutch for preventing rotation of said roll of tape in an unwinding direction when said wrap spring clutch is engaged and for permitting free rotation of said roll of tape when said wrap spring clutch is disengaged, and B) means for engaging said wrap spring clutch to prevent rotation of said roll of tape in an unwinding direction when tape is not being withdrawn by the feeding means in the mailing machine, and for disengaging said wrap spring clutch when tape is being withdrawn by the feeding means in the mailing machine and the pulling force on the tape exceeds a predetermined amount and also when said tape holding means is moved to said uppermost position to permit said roll of tape to rotate in an unwinding direction.

10. A tape storage apparatus as set forth in claim 9 wherein said means for engaging and disengaging said wrap spring clutch comprises means interconnected between said tape holding means and said tape tensioning means for actuating said wrap spring clutch engaging and disengaging means of said tape tensioning means.

11. A tape storage apparatus as set forth in claim 9 wherein said tape tensioning means further includes means for detecting when said roll of tape is exhausted and for providing an indication of this condition.

12. A tape storage apparatus as set forth in claim 11 wherein said means for detecting when said roll of tape is exhausted comprises:

A) an element mounted on said tape holding means for movement in response to changes in the pulling force on the tape, B) resilient means urging said element is a direction opposite to that in which it is moved by the normal pulling force on the tape, and C) means responsive to said element being moved to a limit position by said resilient means for providing a visual indication that said element is in said limit position and is no longer under the influence of tape.

* * * * *